United States Patent [19]

Gellatly

[11] Patent Number: 4,706,692

[45] Date of Patent: Nov. 17, 1987

[54] METHOD AND APPARATUS FOR COATING RECONSTITUTED TOBACCO

[75] Inventor: Grant Gellatly, Chaster, Va.

[73] Assignee: Philip Morris Incorporated, New York, N.Y.

[21] Appl. No.: 814,393

[22] Filed: Dec. 30, 1985

[51] Int. Cl.[4] ..... A24B 3/14

[52] U.S. Cl. ..... 131/370; 131/300; 131/304

[58] Field of Search ..... 131/300, 304, 370, 371, 131/372, 373, 374, 375, 390

[56] References Cited

U.S. PATENT DOCUMENTS 4,421,126 12/1983 Gellatly ..... 131/371

OTHER PUBLICATIONS

Jacobs, "Fundamentals to Consider in Selecting Coating Methods", Cameron-Waldron-Hartig Division, Midland-Ross Corporation.

*Primary Examiner*—V. Millin

*Attorney, Agent, or Firm*—Jeffrey H. Ingerman

[57] ABSTRACT

A method and apparatus for coating reconstituted tobacco are provided. A web of reconstituted tobacco is coated on both sides with slurries of tobacco particles in tobacco sizing liquor. A forward roll coater coats one side, and supports the web while a reverse roll coater coats the other side. The web adheres to the forward roll coater by virtue of the presence of the coating on the first side, so that the reverse roll coater does not tear the wet, relatively weak web.

6 Claims, 1 Drawing Figure

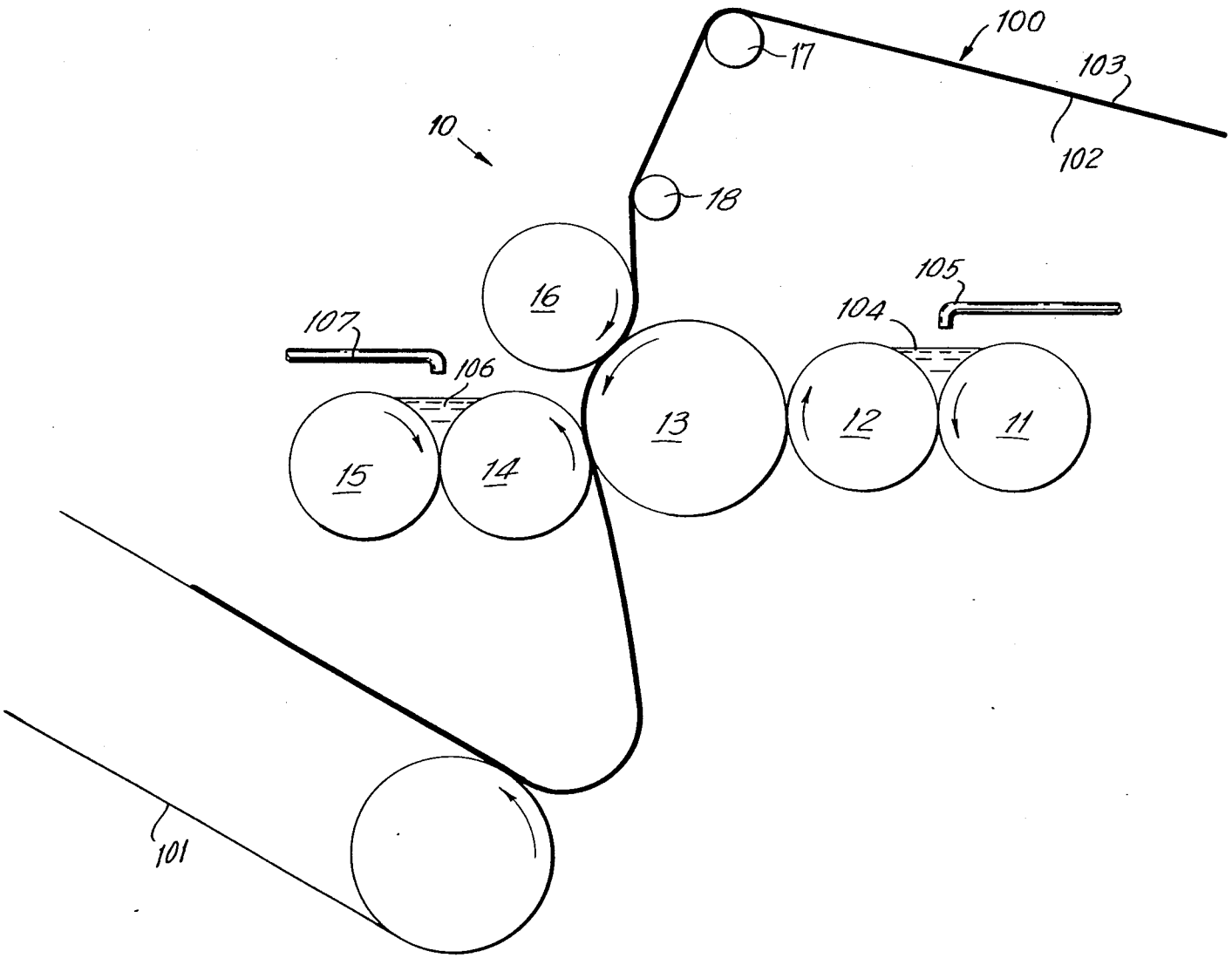
100
103
102
17
18
10
16
13
14
15
106
107
105
104
12
11
101

METHOD AND APPARATUS FOR COATING RECONSTITUTED TOBACCO

BACKGROUND OF THE INVENTION

This invention relates to a method and apparatus for coating a web of reconstituted tobacco, and particularly to a method and apparatus for coating both sides of a web of reconstituted tobacco without the web having to travel unsupported at any point during coating.

Reconstituted tobacco is typically made by recovering small fragments and particles of tobacco and tobacco dust which are generated during tobacco processing and forming them into a sheet or web. A web of reconstituted tobacco can be made by forming a liquid suspension of the tobacco particles, and then forming the sheet by casting the suspension on a solid substrate, or depositing it on a screen or "wire" such as is used in the Fourdrinier paper-making process, and allowing the liquid to drain off. When the remaining solids are dried, a sheet of tobacco similar to paper results.

The tobacco "paper" is low in flavor and other subjective components. Many of the subjective components are dissolved in the liquid used to make the sheet. The sheet is therefore customarily "sized" by saturation in a bath of "size"—i.e., a liquor of tobacco solubles—which are frequently recovered at least in part from the sheet-making process.

When very fine tobacco particles and tobacco dust are used in the sheet-making process, particularly in the Fourdrinier-type process, they may pass through the screen with the liquid and not remain in the sheet. Alternatively, they may become caught in the screen, preventing liquid from draining and reducing the product capacity of the equipment.

Therefore, it is known to mix very fine tobacco particles and tobacco dust with a liquid—e.g., the sizing liquor—to form a slurry and then to apply the slurry as a coating to one or both sides of a reconstituted tobacco sheet. Although the fine particles and dust do not significantly improve the subjective qualities of the reconstituted tobacco sheet, coating them as a slurry allows their volume to be added to the sheet without fouling the sheet-making equipment. Such a process is disclosed in commonly-assigned U.S. Pat. No. 4,421,126, in which it is taught that the slurry can be applied by a blade coater.

Reconstituted tobacco sheet has a relatively low wet strength. For that reason, when it has been desired in the past to coat both sides of a sheet of reconstituted tobacco, the practice has been to coat one side, dry the sheet, coat the other side, and again dry the sheet. Furthermore, it has been necessary to support the wet coated sheet as it passes through any open draws in the equipment to prevent it from tearing under its own weight. The known equipment for coating both sides of a reconstituted tobacco sheet therefore takes up relatively large amounts of space, operates relatively slowly and consumes relatively large amounts of energy, particularly for drying.

SUMMARY OF THE INVENTION

It is an object of this invention to provide a method and apparatus for coating both sides of a web of reconstituted tobacco without having to dry the web between the coating of the first side and the coating of the second side.

It is a further object of this invention to provide a method and apparatus for coating both sides of a web of reconstituted tobacco in which the web does not pass through any open draws.

In accordance with this invention, there is provided apparatus for applying a slurry of coating material to both sides of a web of reconstituted tobacco. The apparatus comprises forward roll coating means for applying a first layer of slurry to one side of the sheet and reverse roll coating means immediately adjacent the forward roll coating means for applying a second layer of slurry to the other side of the sheet. The web is continually supported from the point at which it engages the forward roll coating means to the point at which it leaves the reverse roll coating means.

In the method of the invention reverse roll coating means is provided immediately adjacent forward roll coating means. A slurry of coating material is applied to the forward roll coating means and to the reverse roll coating means. A first layer of slurry is applied to one side of the web with the forward roll coating means. A second layer of slurry is applied to the other side of the web with the reverse roll coating means. The web is supported from the beginning of the step of applying slurry to the first side until the end of the step of applying slurry to the second side.

BRIEF DESCRIPTION OF THE DRAWING

The above and other objects and advantages of the invention will be apparent upon consideration of the following detailed description, taken in conjunction with the accompanying drawing, which is a schematic elevational view of apparatus according to the present invention configured for coating a web.

DETAILED DESCRIPTION OF THE INVENTION

The present invention can be used to apply any type of coating to a web of reconstituted tobacco. Any type of coating can be applied, and, if desired, different coatings could be applied to each side. The preferred coating for both sides of the web is a slurry of particles of tobacco—of the type referred to as "class tobacco"—in a tobacco sizing liquor. "Class tobacco" consists of tobacco particles of a size generally less than 30 mesh. These particles result from natural breakage of tobacco and are collected during all stages of tobacco processing.

A preferred embodiment of the apparatus of the present invention is shown in schematic elevation in the figure. Apparatus 10 has a forward roll coating stage including rolls 11, 12, 13, 16, and a reverse roll coating stage including rolls 13, 14, 15. Rolls 11-16 are preferably rubber coated, although it is sufficient that no uncoated rolls touch one another. Reconstituted tobacco web 100 passes over idler rollers 17, 18, and through the nip between rolls 13, 16, along the surface of roll 16 and through the nip between rolls 13, 14. It is then allowed to free-fall, without tension, onto belt 101, which carries it to a dryer (not shown).

The forward roll coating stage applies a slurry coating to side 102 of web 100, which is the bottom side of web 100 both as web 100 enters apparatus 10 and as web 100 is carried away on belt 101. The reverse roll coating stage applies a slurry coating to side 103 of web 100, which is the top side of web 100 as it enters and leaves apparatus 10.

A reservoir 104 of slurry for the forward roll coating stage is formed in the nip between rolls 11, 12, and is supplied by pipe 105. Rolls 11, 12 are the forward roll coating metering rolls, which meter the correct amount of slurry, as discussed below, from reservoir 104 onto the surface of forward roll coating transfer roll 13. Web 100 is held against transfer roll 13 by lay-on roll 16 so that a slurry coating is applied to side 102 of web 100.

A reservoir 106 of slurry for the reverse roll coating stage is formed in the nip between reverse roll coating metering roll 15 and reverse roll coating transfer roll 14, and is supplied by pipe 107. The slurry in reservoir 106 could be the same as, or different from, the slurry in reservoir 104, as desired. Metering roll 15 meters the correct amount of slurry, as discussed below, from reservoir 106 onto the surface of transfer roll 14. Transfer roll 14, traveling in a direction opposite that of web 100, coats side 103 of web 100 by a reverse roll wiping action while web 100 is supported by forward roll coating transfer roll 13.

Web 100 is supported by roll 13 at all times from the beginning of the forward roll coating at the nip of rolls 13, 16 to the end of the reverse roll coating at the nip of rolls 13, 14. Reverse roll coating of web 100 by transfer roll 14 is possible because web 100 adheres to roll 13 by virtue of an adhesive action of the slurry layer between side 102 of web 100 and the surface of roll 13. Because of this adhesive action, web 100 does not tear under the reverse rolling action of roll 14, despite the low wet strength of web 100, so that web 100 need not be dried between the steps of coating each side 102, 103.

The amount of coating that can be applied by forward roll coating is essentially limited by the absorbency of the surface to be coated. Reverse roll coating, on the other hand, is similar in action to a paintbrush, and can wipe relatively thick coatings onto a surface. However, it is not possible to reverse roll coat both sides of web 100 because the forward roll coating step is needed to hold the web against the reverse roll wiping action.

The uncoated reconstituted tobacco web 100 has a density in the preferred embodiment of from about 57 $g/m^2$ to about 92 $g/m^2$. Using the present invention, a total weight of from about 43 $g/m^2$ to about 140 $g/m^2$ of the preferred coating can be applied, for a total coated web weight of from about 100 $g/m^2$ to about 232 $g/m^2$. From about 43 $g/m^2$ to about 108 $g/m^2$ of coating is applied to top side 103 of web 100 by reverse roll coating, while up to about 32 $g/m^2$ of coating is applied to bottom side 102 of web 100 by forward roll coating. The amount of coating that can be applied may vary with the characteristics of both the coating and the base web.

In the preferred embodiment, web 100 moves through apparatus 10 at a rate of from about 40 ft./min. to about 400 ft./min. The various rolls 11–16 rotate in the directions shown by the arrows. The surfaces of forward roll coating transfer roll 13 and forward roll coating lay-on roll 16 move at the same rate as the web, while the surface of reverse roll coating transfer roll 14 moves at a rate of from about 100 ft./min. to about 1,000 ft./min. The surfaces of forward roll coating metering rolls 11, 12 move at a rate of from about 150 ft./min. to about 1,500 ft./min., while the surface of reverse roll coating metering roll 15 moves at a rate of from about 80 ft./min. to about 800 ft./min.

The spacings between the various rolls are a function of the speeds of web 100 and the roll surfaces, and the desired coating thicknesses. In the preferred embodiment, lay-on roll 16 is spaced from forward roll coating transfer roll 13 a distance equal to the sum of the thickness of web 100 and of the coating to be applied to bottom side 102. The spacings between forward roll coating metering rolls 11, 12 and between rolls 12, 13 are relatively large—from about 0.006 inch to about 0.012 inch—to allow as much coating as possible to be transferred to roll 13, and hence to side 102 of web 100, in view of the limitations of forward roll coating. Transfer rolls 13, 14 are spaced from one another a distance equal to the expected thickness of web 100 with both sides 102, 103 coated. Transfer roll 14 contacts reverse roll coating metering roll 15 along a line at a linear pressure of from about 2 pounds per linear inch to about 4 pounds per linear inch.

Thus it is seen that a method and apparatus are produced for coating both sides of a web of reconstituted tobacco without having to dry the web between the coating of the first side and the coating of the second side, and without the web passing through any open draws. One skilled in the art will recognize that the inventive principles disclosed herein can be practiced in other than the embodiments shown, which are presented for purposes of illustration and not of limitation, and the present invention is limited only by the claims which follow.

What is claimed is:

1. Apparatus for applying slurries of coating material to both sides of a web of reconstituted tobacco, said apparatus comprising:

forward roll coating means for applying a first layer of slurry to one side of said web; and reverse roll coating means adjacent said forward roll coating means for applying a second layer of slurry to the other side of said web; wherein said web is continually supported by said forward roll coating means from the point at which it engages said forward roll coating means to the point at which it leaves said reverse roll coating means, said forward roll coating means adhering to said web, whereby said web is prevented from being torn by said reverse roll coater.

2. The apparatus of claim 1 wherein said forward roll coating means adheres to said one side of said web by virtue of said first layer of slurry having been applied to said one side.

3. A method of applying slurries of coating material to both sides of a web of reconstituted tobacco, said method comprising the steps of:

providing forward roll coating means and reverse roll coating means adjacent said forward roll coating means;

applying slurries of coating material to said forward roll coating means and to said reverse roll coating means;

applying a first layer of slurry to one side of said web with said forward roll coating means;

applying a second layer of slurry to the other side of said web with said reverse roll coating means; and supporting said web from the beginning of said step of applying slurry to said one side until the end of said step of applying slurry to said other side.

4. The method of claim 3 wherein said supporting step is carried out by said forward roll coating means.

5. The method of claim 4 further comprising adhering said one side of said web to said forward roll coating means, thereby preventing said web from being torn by said reverse roll coating means.

6. The method of claim 5 wherein said adhering occurs by virtue of said one side of said web having been contacted with said slurry on said forward roll coating means.

* * * * *